US009611076B2

(12) United States Patent
Mosley et al.

(10) Patent No.: US 9,611,076 B2
(45) Date of Patent: Apr. 4, 2017

(54) HANGING MILK STORAGE BAG

(71) Applicants: Alan Jeffrey Mosley, New Braunfels, TX (US); Decha Boontawee, Panusnikom (TH); Jan Patvibul, Panusnikom (TH); Chaiyawat Nirundorn, Panusnikom (TH)

(72) Inventors: Alan Jeffrey Mosley, New Braunfels, TX (US); Decha Boontawee, Panusnikom (TH); Jan Patvibul, Panusnikom (TH); Chaiyawat Nirundorn, Panusnikom (TH)

(73) Assignee: Minigrip LLC, Seguin, TX (US)

( * ) Notice: Subject to any disclaimer, the term of this patent is extended or adjusted under 35 U.S.C. 154(b) by 0 days.

(21) Appl. No.: 14/058,635

(22) Filed: Oct. 21, 2013

(65) Prior Publication Data

US 2015/0110424 A1 Apr. 23, 2015

(51) Int. Cl.
*B65D 33/00* (2006.01)
*B65D 33/25* (2006.01)

(52) U.S. Cl.
CPC ..... *B65D 33/2533* (2013.01)

(58) Field of Classification Search
CPC ..... B65D 33/2533; B65D 75/008; B65D 75/5805; B29C 65/00; B29C 66/8122
USPC ..... 383/63, 200–209, 41, 66; 215/11.3
See application file for complete search history.

(56) References Cited

U.S. PATENT DOCUMENTS

| | | | | |
|---|---|---|---|---|
| 2,499,528 | A * | 3/1950 | Reitzes | 383/208 |
| 4,696,404 | A * | 9/1987 | Corella | 383/200 |
| 5,104,235 | A * | 4/1992 | Bronstrup et al. | 383/10 |
| 5,683,029 | A * | 11/1997 | Lyons | 229/309 |
| 6,206,571 | B1 * | 3/2001 | Olin | 383/204 |
| 6,318,893 | B1 * | 11/2001 | Gates | 383/200 |
| 7,311,649 | B1 * | 12/2007 | Plourde | 493/213 |
| 7,665,894 | B2 * | 2/2010 | DeBlander | B65D 33/08 383/10 |
| 8,007,174 | B2 * | 8/2011 | Yamaguchi et al. | 383/9 |
| 2001/0038723 | A1 * | 11/2001 | Gates | 383/200 |
| 2003/0103696 | A1 * | 6/2003 | Faaborg et al. | 383/211 |
| 2003/0169947 | A1 * | 9/2003 | Taheri | 383/5 |
| 2005/0089250 | A1 * | 4/2005 | Laske et al. | 383/66 |
| 2006/0072858 | A1 * | 4/2006 | Kurosawa et al. | 383/44 |
| 2006/0104550 | A1 * | 5/2006 | Kuge et al. | 383/206 |
| 2007/0071363 | A1 * | 3/2007 | DeBlander et al. | 383/9 |
| 2008/0037912 | A1 * | 2/2008 | Martuch | 383/205 |
| 2008/0285897 | A1 * | 11/2008 | Taheri | B29C 66/432 383/209 |

* cited by examiner

*Primary Examiner* — Peter Helvey
(74) *Attorney, Agent, or Firm* — Senniger Powers LLP

(57) ABSTRACT

The present disclosure relates to a storage bag for expressed mother's milk, particularly one which can receive the milk directly from a pump. The hanging milk storage bag includes semi-circular perforations or other lines of weakness for creating an aperture to receive the breast milk pump. The hanging milk storage bag further includes upper linear perforations or other lines of weakness for creating an opening at the top of the hanging milk storage bag for pouring the contents into a subsequent receptacle. The hanging milk storage bag further includes a leak-resistant zipper for forming a storage volume.

19 Claims, 1 Drawing Sheet

HANGING MILK STORAGE BAG

BACKGROUND OF THE DISCLOSURE

Field of the Disclosure

The present disclosure relates to a storage bag for expressed mother's milk, particularly one which can receive the milk directly from a pump.

Description of the Prior Art

In the prior art, a pump is used to express mother's breast milk into a bottle. The milk is then poured from the bottle into a milk storage bag for freezing, transportation and storage. This makes it necessary to wash the bottle after every use and further increases the chance of spillage. Other prior art requires adapters between the pump and the milk storage bag which, similarly, entails extra cleaning steps.

OBJECTS AND SUMMARY OF THE DISCLOSURE

It is therefore an object of the present disclosure to provide a milk storage bag wherein the milk may be expressed directly from the pump into the milk storage bag, with a minimum of additional components required.

These and other objects are attained by providing a milk storage bag wherein the bag is elongated above the zipper thereby allowing room for a semi-circular perforation at one side seal of the bag. The upmost portion of the perforation is situated below the top opening perforation. Then the interior of the perforation is removed, a circular hole or aperture is formed. The hole or aperture is sized to allow the intake tube of the pump to be inserted into the hole or aperture, while the exit of the pump is situated in the bag. The hole or aperture is designed to be far enough above the zippers so that they can be closed after pumping has finished, but before the bag is removed from the pump.

A partial seal is employed near the other side seal of the bag, in line with the upper portion of the perforation that makes the hole or aperture described above. This is designed to keep the bag from slipping from the pump while in use. This partial seal is typically not intended to make a full seal with the pump. Rather, it is typically intended to keep the bag connected to the pump so that the expressed milk is directed into the bag when kept generally upright.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
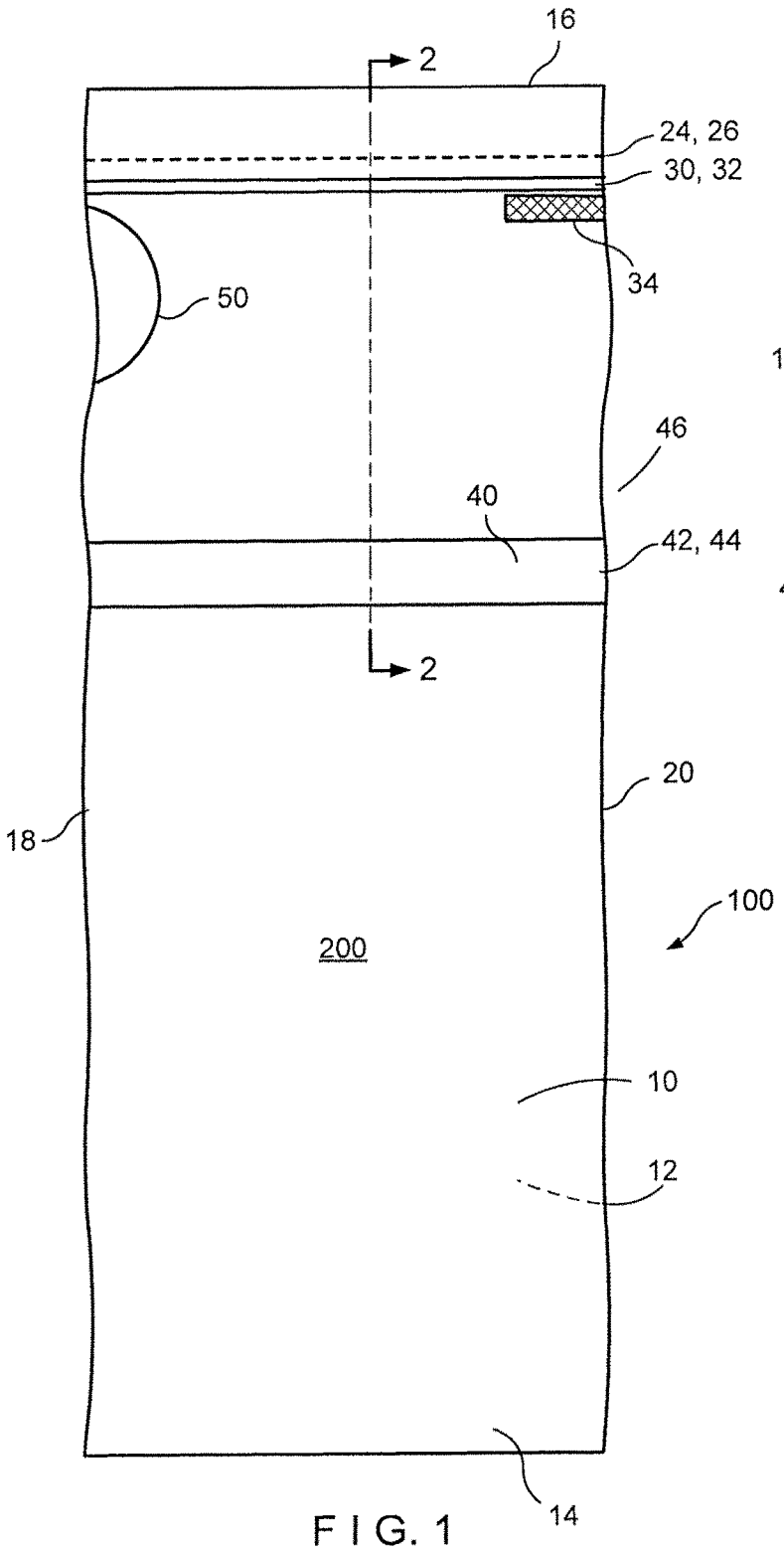
FIG. 1 is a front plan view of an embodiment of the package of the present disclosure.
Figure 2:
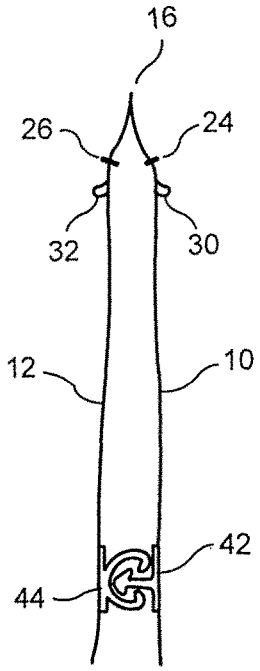
FIG. 2 is a cross-sectional view along plane 2-2 of FIG. 1.

Referring now to the drawings in details wherein like numerals refer to like elements throughout the several views, one sees that FIG. 1 is a front plan view of a hanging milk storage bag 100, which is an embodiment of the present disclosure.

The hanging milk storage bag 100 includes a front wall 10 and a rear wall 12. The corresponding edges of front and rear walls 10, 12 are joined or sealed together to form gusseted bottom 14, top seal 16 and first and second side seals 18, 20.

Front and rear walls 10, 12 are typically formed of polymeric material, but are not limited thereto. First and second top-opening perforated lines or other lines of weakness 24, 26 are formed in front and rear walls 10, 12, respectively, immediately downwardly adjacent from top seal 16. Grip strips 30, 32 are located on the exterior of front and rear walls 10, 12, respectively immediately below or downwardly adjacent from first and second top-opening perforated lines or other lines of weakness 24, 26. Seal 34 is formed between front and rear walls 10, 12, immediately below or downwardly adjacent from grip strips 30, 32, extending from side seal 20 across a partial width of hanging milk storage bag 100. Seal 34 is intended to keep the hanging milk storage bag 100 from slipping from the pump (not shown) while in use.

Zipper 40 includes first and second zipper profiles 42, 44. First zipper profile 42 is illustrated as a male profile and second zipper profile 44 is illustrated as a female profile for interlocking with the male profile, but a wide range of zipper configurations are possible with this disclosure. First zipper profile 42 is sealed or otherwise joined to the interior of front wall 10 at about a two-thirds or three-quarter height position of the hanging milk storage bag 100. Likewise, second zipper profile 42 is sealed or otherwise joined to the interior of rear wall 12 at about a two-thirds or three-quarter height position of the hanging milk storage bag 100.

A storage volume 200, for mother's milk or other liquid, is thereby defined or bounded by gusseted bottom 14, first and second side seals 18, 20 and zipper 40. First and second zipper profiles 42, 44 can interlock in a leak-resistant configuration to maintain the mother's milk or other liquid within storage volume 200, and can subsequently be separated in order to dispense the milk or other liquid from the storage volume 200.

Above the zipper 40 and the storage volume 200, a header portion 46 is defined by the remaining portion of the front and rear walls 10, 12. On the header portion 46, bounded by first side seal 18 and inwardly arcuately extending, a semicircular perforation or other line of weakness 50 is formed in both front and rear walls 10, 12, co-extensively. The uppermost portion of semicircular perforation or other line of weakness 50 is formed immediately below the first and second top-opening perforated lines or other lines of weakness 24, 26. When the front and rear walls 10, 12 are torn along semicircular perforation or other line of weakness 50 and the material removed, a round aperture is formed as bounded by the remaining edges of semicircular perforation or other line of weakness 50, a first half (or 180 degrees) within front wall 10, the second half (or 180 degrees) within rear wall 12. This resulting round aperture is sized to allow the intake tube of the pump (not shown) to be inserted into the round aperture, while the exit of the pump extends through zipper 40 into the storage volume 200 so that the breast milk is pumped directly into storage volume 200. The resulting round aperture is positioned to be far enough above zipper 40 so that the zipper 40 can be closed (i.e., first and second zipper profiles 42, 44 interlocked) after the pumping operation has finished, but before the hanging milk storage bag 100 is removed from the pump.

After the pumping operation, the pump can be removed from the hanging milk storage bag 100 and the zipper 40 can be closed. The hanging milk storage bag 100 can be transported and, if necessary, used to contain the milk during freezing. After transportation and, if necessary, thawing, the zipper 40 can be opened and the milk poured directly into a subsequent receptacle, such as, but not limited to, a baby bottle.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A storage bag for liquids, comprising:

a front wall and a rear wall, the storage bag having a top edge margin, a bottom edge margin, first and second side edge margins, and a width extending between the first and second side edge margins, the front and rear walls being joined together along at least the bottom edge margin and the first and second side edge margins of the storage bag to define a storage volume; and a zipper extending across the width of the storage bag at a location spaced apart between the top edge margin and the bottom edge margin and configured for selectively closing and opening the storage volume, the zipper defining a storage portion and a header portion of the storage bag;

the header portion including a seal joining the front and rear walls, the seal being spaced apart between the top edge margin of the storage bag and the zipper and extending from an outer end adjacent the second side edge margin across a portion of the width of the storage bag to an inner end spaced apart from the first side edge margin of the bag by at least about half of the width of the storage bag, the seal defining an opening extending between the inner end of the seal and the first side edge margin of the storage bag and the seal being configured to keep the storage bag from slipping from the pump when the pump is inserted into the storage bag through the opening.

2. The storage bag of claim 1 wherein the header portion includes an intake tube formation formed at the first side edge margin of the header portion configured to define a passage through the bag for inserting an intake tube of a pump through the header portion of the storage bag.

3. The storage bag of claim 2 wherein the intake tube formation includes a first semi-circular line of weakness on the front wall and a second semi-circular line of weakness on the rear wall, the first and second lines of weakness extending circumferentially around a removable panel of the bag.

4. The storage bag of claim 3 wherein the first and second lines of weakness are co-extensive with each other.

5. The storage bag of claim 2 wherein the front and rear walls are joined together along a segment of the first side edge margin extending upward from the intake tube formation toward the top edge margin of the storage bag, said segment being configured to engage the intake tube of the pump inserted through the passage.

6. The storage bag of claim 2 wherein the intake tube formation includes an aperture extending through the front and rear walls and forming the passage.

7. The storage bag of claim 1 wherein the front and rear walls are made of polymeric material.

8. The storage bag of claim 1 further including first and second grip strips on the front and rear walls, respectively.

9. The storage bag of claim 1 wherein the front and rear walls are joined together along the top edge margin of the bag.

10. The storage bag of claim 9 wherein a line of weakness is formed in each of the front and rear panels, each of the lines of weakness extending across the width of the storage bag at a location spaced apart between the top edge margin and the zipper.

11. The storage bag of claim 10 further comprising first and second grip strips spaced apart between the line of weakness and the zipper on the front and rear walls, respectively.

12. The storage bag of claim 1 wherein the header portion includes a zone of weakness extending circumferentially around a removable panel.

13. The storage bag of claim 12 wherein the removable panel is selectively removable by tearing the header portion of the storage bag along the zone of weakness whereby the removable panel is separated from the storage bag and the header portion defines an intake tube aperture having a perimeter.

14. The storage bag of claim 13 wherein the header portion is shaped and arranged so that when the removable panel is separated from the storage bag, the header portion extends circumferentially around the entire perimeter of the intake tube aperture in an open configuration such that the intake tube aperture is configured for receiving an intake tube of a pump inserted between the front and rear walls of the header portion in the open configuration.

15. The storage bag of claim 12 wherein the removable panel spans a segment of the first side edge margin of the storage bag and includes a front portion formed by the front wall and a contiguous rear portion formed by the rear wall.

16. The storage bag of claim 15 wherein the removable panel is generally circular.

17. The storage bag of claim 16 wherein the removable panel wherein the front portion of the removable panel is generally semicircular and the rear portion of the removable panel being generally semicircular.

18. The storage bag of claim 13 wherein the front and rear portions of the removable panel are about the same size.

19. The storage bag of claim 15 wherein the zone of weakness includes a front segment and a rear segment that is generally coextensive with the front segment.

* * * * *